United States Patent [19]

Spears

[11] Patent Number: 4,504,199

[45] Date of Patent: Mar. 12, 1985

[54] FLUID PUMP

[76] Inventor: Harry L. Spears, 6307 Glenhill, Spring, Tex. 77379

[21] Appl. No.: 487,287

[22] Filed: Apr. 21, 1983

[51] Int. Cl.[3] ..... F04B 21/02; F04B 39/08

[52] U.S. Cl. ..... 417/456; 417/514

[58] Field of Search ..... 417/456–458, 417/511–514, 520; 137/614.2; 74/424.8 V

[56] References Cited

U.S. PATENT DOCUMENTS

| | | | |
|---|---|---|---|
| 42,705 | 5/1864 | Warren | 417/511 |
| 456,128 | 7/1891 | Darling | 417/434 |
| 1,567,827 | 12/1929 | Zublin | 417/513 |
| 1,698,163 | 1/1929 | MaGee . | |
| 1,784,602 | 12/1930 | Kirkpatrick | 417/511 |
| 2,791,970 | 5/1957 | Hunter | 417/456 |
| 2,933,050 | 4/1960 | Crowl | 417/513 |
| 3,023,710 | 3/1962 | Tyree | 417/520 |
| 3,612,101 | 10/1971 | Pavlovich | 137/614.2 |
| 3,697,199 | 10/1972 | Spears | 417/498 |

OTHER PUBLICATIONS

Prior art cited in prior application of Harry L. Spears, Ser. No. 075,318, filed 9/13/79, status of application unknown.

Brochure of Watson International Oilfield Industries entitled "The Watson Pump Kit".

*Primary Examiner*—William L. Freeh

*Attorney, Agent, or Firm*—Ben D. Tobor

[57] ABSTRACT

A fluid pump for raising petroleum fluids through production tubing in completed oil wells includes two mechanically actuated valves, one of which moves longitudinally within the pump housing, and the other valve which rotates within the pump housing.

51 Claims, 6 Drawing Figures

80
82
81
71
85
85
83
89
91
86
84
94
91
94
88
87
118
76
90
92
93
93
103
94
103
109
102
101
114
111
113
79
99
100
110
98
77
119
120
105
107
108
78
108

FLUID PUMP

FIELD OF THE INVENTION

The invention relates to a fluid pump for elevating fluids, and in particular, to a pump for raising petroleum fluids through production tubing in completed oil wells.

DESCRIPTION OF THE PRIOR ART

A conventional oil well includes a cased well bore with one or more strings of tubing extending downwardly through the casing into the oil or other petroleum fluid contained in the sub-surface mineral formation to be produced. The casing is perforated at the level of the production zone to permit fluid flow from the formation into the casing, and the lower end of the tubing string is generally open to provide entry for the fluid into the tubing.

One type of pump conventionally employed in structures of the type described is wedged into an internal constriction or seating nipple formed internally of the tubing below the fluid level. A metallic enlargement on the external body of the pump prevents it from travelling below the seating nipple and resilient seal rings on the body of the pump housing act to form a leak proof seal between the seating nipple and pump housing. The pump is generally driven by a mechanical linkage of metal rods, generally referred to as sucker rods, or valve rods, which extend from the pump to the well surface. The valve rod, or sucker rod, linkage is powered in a reciprocating motion by a conventional mechanical apparatus, usually called a pumping unit located at the well surface.

The conventional pump itself generally includes a housing through which a piston is reciprocated by the sucker rod, or valve rod, linkage. In its simplest form, the conventional pump of the type described often includes a number of ball and seat valves with one such valve in the piston and another at the inlet port of the housing. On the upstroke of the plunger, the ball in the inlet port valve is drawn away from its seat and the ball of the outlet port valve is forced over its seat to draw fluid from below the sealing nipple and into the housing. On the piston's downstroke, the ball in the inlet valve is forced onto its seat and the ball in the piston valve moves away from its seat to allow the piston to move downwardly through the fluid contained in the housing. On the subsequent upstroke, the closing of the piston valve forces the fluid above the piston out of the housing through the outlet ports and into the tubing above the sealing nipple and simultaneously fills the housing below the piston with fluid. Repetition of this cycle eventually fills the tubing string and causes the fluid to flow to the surface.

The previously described pump or some variation thereof is probably the most widely employed in applications where it is desired to drive a sub-surface pump by a surface powered, mechanical linkage. A significant problem in pumps of this type is caused by wear of the ball and seat valves. The fluid produced from many geological formations contains minute, abrasive particles, such as sand, which lodge between the ball and seat and wear away the valve components. Over a period of time, the sealing efficiency of the valves is reduced to such an extent that the pump must be removed and repaired or replaced. In some wells, where the production fluid is particularly sandy or corrosive, pumps of the type described must be replaced at frequent intervals. It is, of course, evident that removing and repairing or replacing a pump, and the associated losses caused by reduced production time, can be significant expense factors.

An additional problem associated with such conventional types of sub-surface oilfield pumps, is generally known as "gas locking" as will be hereinafter described. In such conventional pumps, the fluid head pressure in the tubing string is held by the outlet port valve, or travelling valve, on the upstroke of the piston and by the inlet port valve, or lower standing valve, on the downstroke thereof. The downstroke of the travelling valve builds up pressure on the fluid between the travelling valve and standing valve which causes the travelling valve to open to allow fluid to pass above the travelling valve, or outlet port valve. However, in a well producing both oil and gas, the chamber between the travelling valve and the standing valve, frequently fills with gas and due to the compressibility of gas, the downstroke of the travelling valve may not build up sufficient pressure in the chamber below said valve to equal the pressure of the fluid column above the valve, thus resulting in the travelling valve remaining closed during its downstroke. Thus, the gas between the standing valve and travelling valve merely compresses and expands with each stroke of the pump, producing the operational failure of the pump known as "gas locking." This condition may remedy itself after a short time or may continue indefinitely.

Another problem associated with such conventional types of sub-surface oilfield pumps is the result of vibration and shock forces associated with the movement of the upper standing valve, or outlet port valve, and the piston, or plunger. Vibration forces associated with the plunger on its upstroke, frequently causes the upper ball and seat valve to vibrate between its open and closed position, whereby the desired positive vacuum caused by the upstroke is not fully obtained. Accordingly, the full amount of fluid which is desired to be pulled, or sucked, up through the inlet port valve is not obtained.

Accordingly, prior to the development of the present invention, there has been no fluid pump for raising petroleum fluids through production tubing in completed oil wells which: eliminates "gas locking"; is not readily susceptible to damage caused by abrasive particles such as sand contained in the fluid being pumped, and thus is economical to use without frequent replacement of valve components; and is not affected by vibration forces. Therefore, the art has sought a fluid pump for raising petroleum fluids through production tubing in completed oil wells which eliminates "gas locking", is not substantially affected by abrasive particles, such as sand, contained within the fluid to be pumped, thus being more economical to use, and is not affected by vibration forces so that the desired amount of fluid may be pumped through the tubing string.

SUMMARY OF THE INVENTION

In accordance with the present invention, the foregoing advantages have been achieved through the present fluid pump. The present invention includes: an elongate housing having upper and lower ends; a first valve disposed in the lower end of the housing; a second valve disposed in the upper end of the housing and slideably mounted for longitudinal movement with respect to the housing; a third valve disposed between the first and second valves; a piston for compressing fluid disposed between the first and third valves; and means for rotating the third valve about its longitudinal axis, said means for rotating being associated with the second and third valves, whereby the longitudinal movement of the second valve causes rotational movement of the third valve. Another feature of the present invention is that the first valve is actuated by changes in fluid pressure occurring in the housing and the second and third valves are mechanically actuated.

A further feature of the present invention is that the second valve may include: a bevelled seating surface disposed toward the upper end of the housing; and a valve member having a spherical sealing surface at its upper end which contacts the bevelled seating surface.

A further feature of the present invention is that the means for rotating the third valve may include an elongate, helically shaped member and a mating guide surface, whereby upon relative movement between the helically shaped member and the guide surface causes rotation of the third valve. An additional feature of the present invention is that the third valve may have the elongate, helically shaped member fixedly secured thereto and the mating guide surface is associated with the second valve. An additional feature of the present invention is that the third valve may include a rotatable elongate, generally cylindrical valve member having an upper end with a sealing surface thereon; and a seating surface in sliding and wiping engagement with the sealing surface. The seating surface may have at least one fluid port formed therein and the mating sealing surface may have at least one fluid port formed therein, whereby upon rotation of the valve member and the fluid port of the valve member is moved from a mating, fluid transmitting relationship with the seating surface port to a closed, sealed relationship with the seating surface port.

Another feature of the present invention is that the third valve member may have its outer cylindrical surface provided with a means for collecting sand and other impurities which may be contained in the fluid to be pumped, and the collection means may comprise a groove formed in the outer surface of the valve member, the groove being disposed intermediate the upper and lower ends of the valve member.

In accordance with the invention, the foregoing advantages have also been achieved through the present mechanically actuated travelling valve and top valve assembly for use in a fluid pump which pump includes an elongate housing, a standing valve in the lower end of the housing, and a piston for compressing fluid disposed above the standing valve. The present invention includes: a first rotatable, elongate, generally cylindrical valve member adapted to be disposed above the piston; a second elongate cylindrical valve member slideably mounted for longitudinal movement with respect to the housing and disposed above the first valve member; and means for rotating the first valve member about its longitudinal axis, said means for rotating being associated with the first and second valve members, whereby longitudinal movement of the second valve member causes rotational movement of the first valve member.

The fluid pump and mechanically actuated travelling valve and top valve assembly of the present invention, when compared with previously proposed prior art fluid pumps, has the advantages of eliminating "gas locking", reduces the problems associated with sand and other abrasive particles contained in the fluid to be pumped, and is not susceptible to vibration forces affecting the amount of fluid to be pumped.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
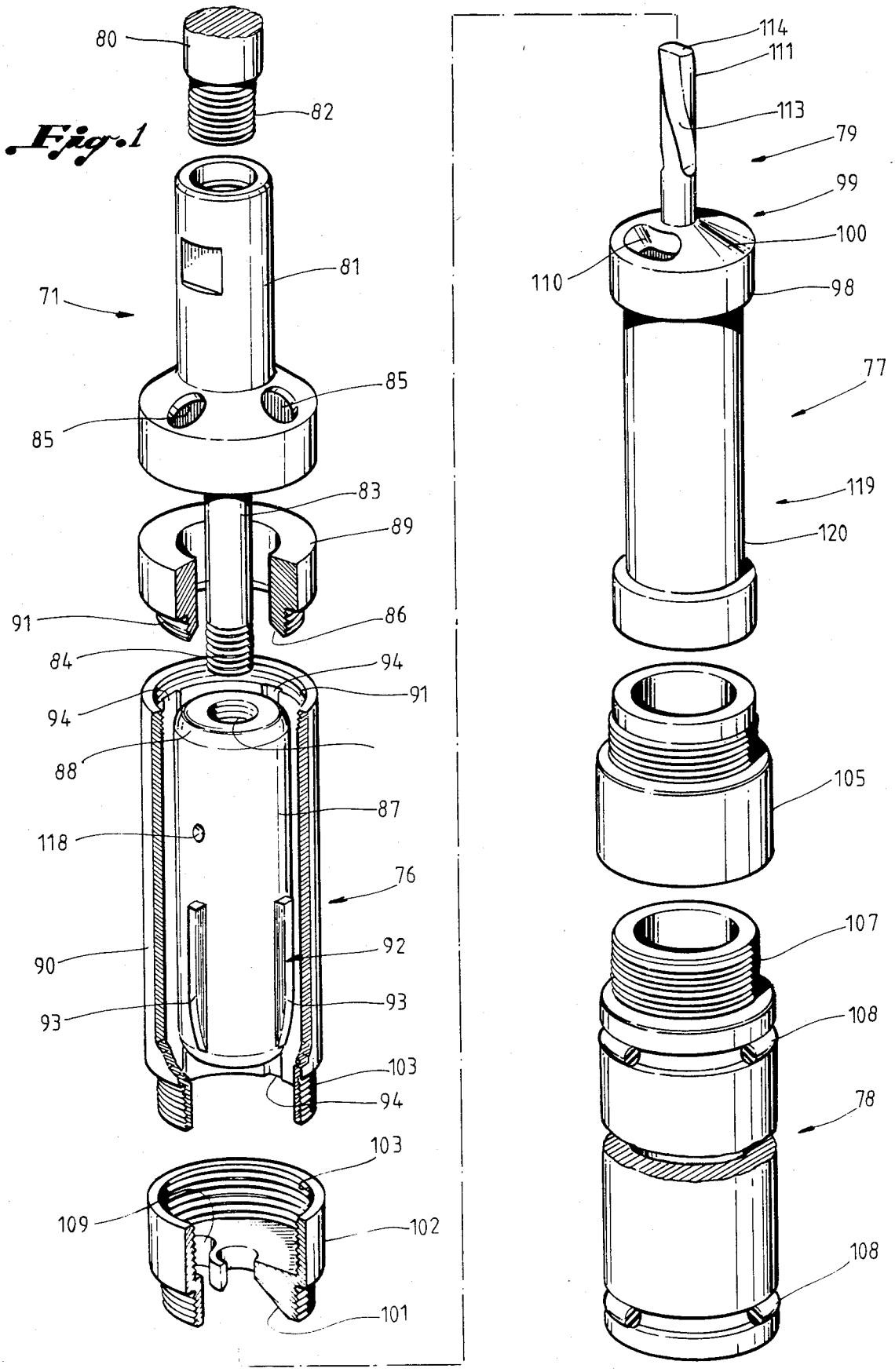
FIG. 1 is an exploded, partial cross-sectional view along the longitudinal axis of a fluid pump in accordance with the present invention.
Figure 2:
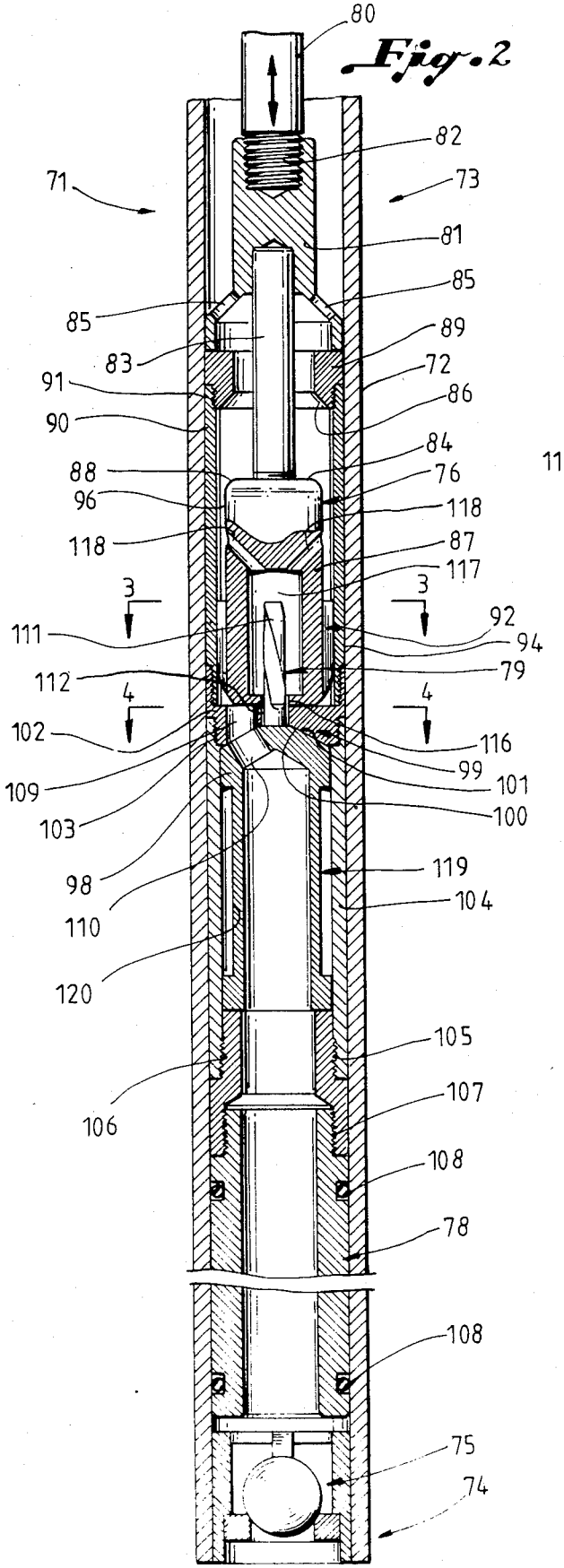
FIG. 2 is a cross-sectional view along the longitudinal axis of the fluid pump of the present invention.

In FIGS. 1 and 2, a fluid pump 71 in accordance with the present invention, is shown to generally comprise: an elongate housing 72 having upper and lower ends 73 and 74 (for ease of illustration purposes, housing 72 has been deleted from FIG. 1); a first valve, or ball and seat standing valve, 75 disposed in the lower end 74 of housing 72; a second valve, or top valve, 76 disposed in the upper end 73 of housing 72; a third valve 77 disposed between the first and second valves 75 and 76; a piston, or plunger, 78 for compressing fluid (not shown) disposed between the first and third valves 75 and 77; and means for rotating 79 the third valve 77 about its longitudinal axis, the means for rotating 79 being associated with the second and third valves 76 and 77, as will be hereinafter described. As is conventional in the art, all of the previous described components of fluid pump 71, as well as the components of pump 71 to be hereinafter described, may be manufactured of any suitable material having the requisite strength and corrosion resistant properties necessary for fluid pumps utilized to pump petroleum fluids, such as any suitable stainless steel material.

Figure 5A:
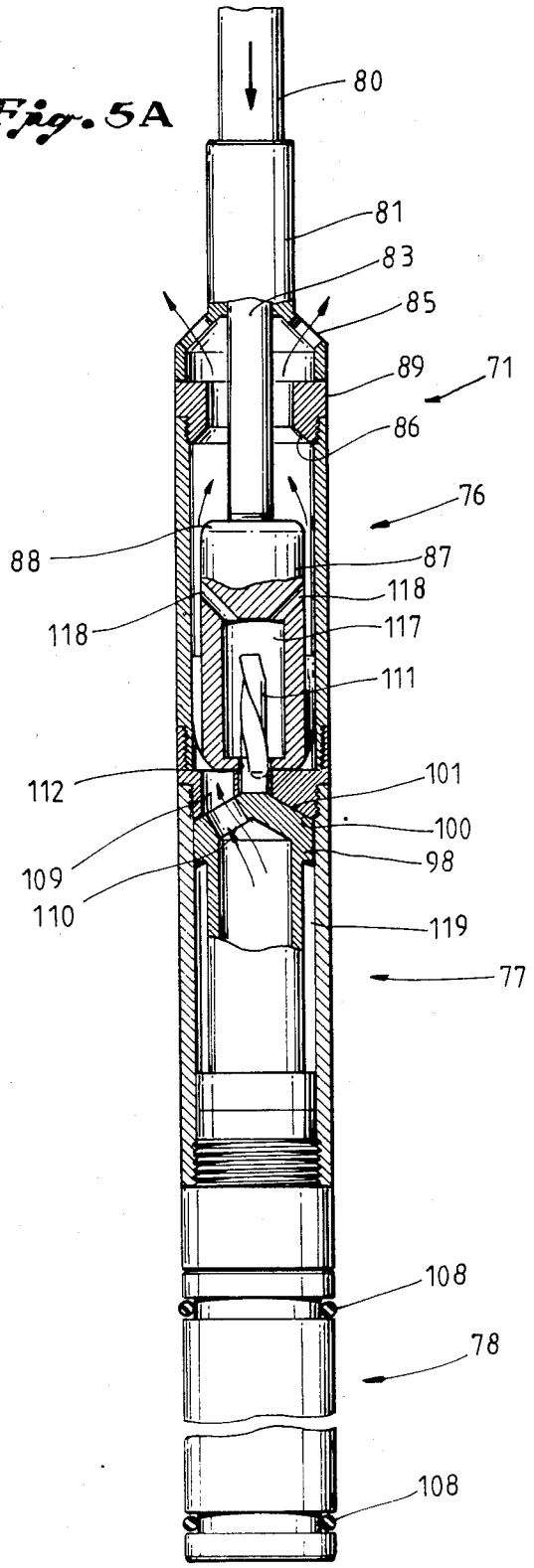
FIGS. 5A and 5B are partial cross-sectional views along the longitudinal axis of the fluid pump illustrating the downstroke and upstroke positions of the various components of the fluid pump.
Figure 5B:
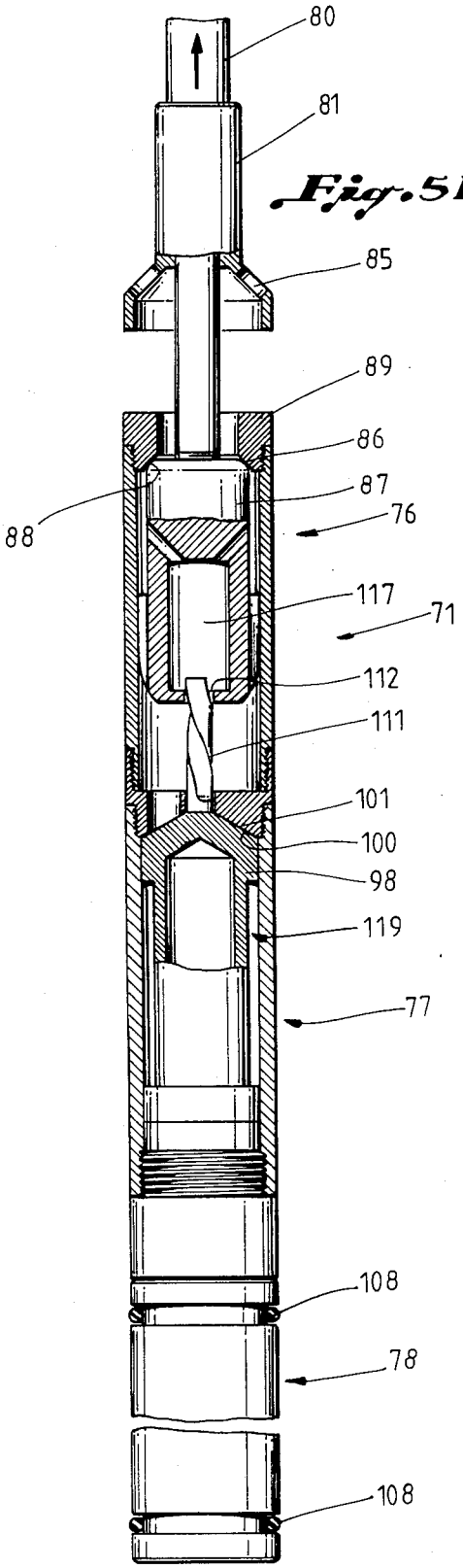

Still with reference to FIGS. 1 and 2, it is seen that fluid pump 71 is actuated, as will be hereinafter described, by a conventional sucker rod, or valve rod, 80 which is associated with the second valve 76 via valve rod connector 81. A conventional threaded connection 82 is provided to connect valve rod 80 to valve rod connector 81 and a downwardly depending connector rod member 83 is fixedly secured to valve rod connector 81 and is threadedly connected to the upper end of second valve member 76 as by a threaded connection 84 as shown in FIGS. 1 and 2. Valve rod connector 81 is provided with a plurality of fluid ports 85 which allow fluid to pass upwardly through the production tubing (not shown) as will be hereinafter described with respect to the downstroke operation of pump 71 as shown in FIG. 5A. Second valve, or top valve, 76 includes a bevelled seating surface 86 disposed toward the upper end 73 of housing 72 and a valve member 87 having a spherical sealing surface 88 at the upper end of valve member 87 which selectively contacts the bevelled seating surface 86 (FIG. 5B). Bevelled seating surface 86 may be preferably formed on a top valve seat member 89 which is threadedly secured to second valve housing, or top valve housing, 90 as by threaded connection 91.

Figure 3:
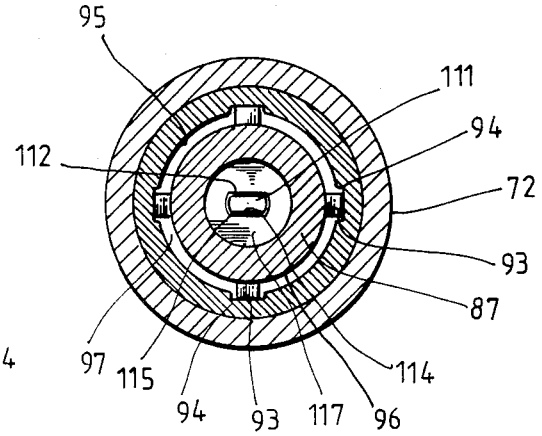
FIG. 3 is a cross-sectional view of the fluid pump taken along line 3—3 of FIG. 2.

Second valve 76, or the second valve member, 87 is slideably mounted for longitudinal movement with respect to the housing 72 as will be hereinafter described. The second valve member, or top valve member, 87 is preferably an elongate cylindrical member, and may preferably include guide means 92 for maintaining the longitudinal movement of the second valve member, or top valve member, 87. With reference to FIGS. 1, 2 and 3, it is seen that guide means 92 preferably comprises a plurality of elongate key members 93 disposed about the circumference of the lower end of top valve member 87, and a plurality of mating keyways formed in the interior surface 95 of top valve housing 90, which keyways 94 extend longitudinally the entire length of top valve housing 90. Keys 93 may extend a greater, or shorter distance, along the outer surface of top valve member 87; however, keys 93 should not extend upwardly so as to interfere with the spherical sealing surface 88 of top valve member 87. As shown in FIGS. 2 and 3, it is seen that the outer surface 96 of top valve member 87 is in a spaced relationship from the interior surface 95 of top valve housing 90 so as to form an annular passageway 97 to allow fluid to flow upwardly through annular passageway 97 when fluid pump 71 is in its downstroke position as shown in FIGS. 2 and 5A.

With reference to FIGS. 1 and 2, the third valve, or travelling valve, 77 will be described in greater detail. The third valve 77 generally includes a rotatable, elongate, generally cylindrical valve member 98 having an upper end 99 with a sealing surface 100 thereon. A seating surface 101 is in sliding and wiping engagement with the sealing surface 100. Preferably, seating surface 101 is formed as a part of a third valve connector member 102, which is threadedly connected as by threaded connections 103 to top valve housing 90, and is threadedly connected to third valve housing member 104. For illustration purposes, third valve housing member 104 is not shown in FIG. 1. Piston, or plunger, 78 is threadedly connected to third valve housing 104 via plunger connector member 105 which is threadedly connected to the lower end of third valve housing 104 as by threaded connection 106. Plunger 78 is in turn threadedly connected to plunger connector member 105 as by threaded connection 107. Plunger 78 may have at least one, and preferably two or more O-rings 108 disposed about the circumference of plunger, or piston, 78, which O-rings 108 are in sealing engagement with the interior surface of housing 72, as seen in FIG. 2.

Figure 4:
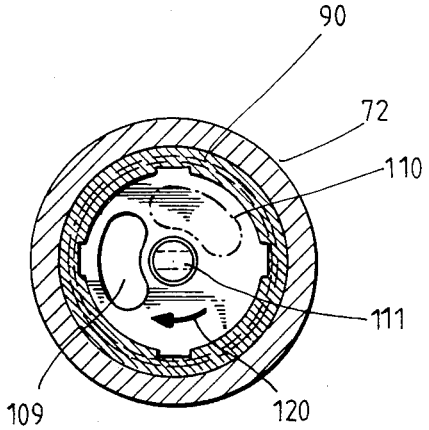
FIG. 4 is a cross-sectional view of the fluid pump taken along line 4—4 of the FIG. 2.

With references to FIGS. 1, 2, and 4, it is seen that seating surface 101 for third valve 77 has at least one fluid port 109 formed therein and the mating sealing surface 100 of third valve member 98 also has at least one fluid port 110 formed therein. Upon rotation of the third valve member 98, as will be hereinafter described, the fluid port 110 of third valve member 98 is moved from a mating, fluid transmitting relationship with the seating surface port 109 (FIG. 2) to a closed, sealed relationship with the seating surface port 109 (FIG. 4). As seen in FIGS. 1 and 2, the upper end 99 of the third valve member 98 preferably tapers upwardly toward the center of the third valve member 98 to form sealing surface 100 and the seating surface 101 is tapered to mate with the sealing surface 100.

With reference to FIGS. 1 and 2, the means for rotating 79 third valve 77 will be described in greater detail. Generally, the rotation means 79 includes an elongate, helically shaped member 111 and a mating guide surface 112, whereby relative movement between the helically shaped member 111 and the guide surface 112 causes rotation of the third valve member 98, as will be hereinafter described. It is seen that the elongate, helically shaped member 111 is fixedly secured to the upper end 99 of the third valve member 98 at its center, and the mating guide surface 112 is associated with the second valve member 87. As seen in FIG. 1, the elongate, helically shaped member 111 has a plurality of helically fluted surfaces 113 and a cross-sectional configuration generally comprised of a rectangle 114 with rounded corners 115 (FIG. 3). The mating guide surface 112 is preferably formed by the interior surface of an opening formed in the lower end of second valve member 87, which opening 116 has a cross-sectional configuration which closely conforms to the cross-sectional configuration 114 of elongate helical member 11. Accordingly, upon longitudinal movement of second valve member 87, caused by the longitudinal movement of valve rod 80, guide surface 112 will contact the helically fluted surfaces 113 of elongate, helical member 111 and third valve member 98 will be forced to rotate about its longitudinal axis. In this regard, it should be noted that rotational movement of second valve member 87 is precluded by key members 93 and keyways 94.

It should be readily apparent to one skilled in the art that elongate, helical member 111 could be associated with the second valve member 87 and guide surface 112 could be associated with third valve member 98, whereby relative movement between the guide surface 112 and helical member 111 will cause the desired rotation of third valve member 98.

With reference to FIGS. 2 and 3, it is seen that the interior of second valve member 87 is provided with an internal chamber 117 which has a plurality of fluid ports 118 in fluid transmitting relationship between internal chamber 117 and the annular chamber 97 between second valve housing 90 and second valve member 87. Fluid ports 118 allow fluid entering internal chamber 117 to pass upwardly out of chamber 117 into the production tubing, as will be hereinafter described.

Fluid pump 71 may also be provided with a means for collecting 119 sand and other impurities, and abrasive particles, which may be contained in the fluid to be pumped. Preferably, the means for collecting sand 119 is provided by a groove 120 formed in the outer surface of the third valve member 98, and the groove 120 is disposed intermediate the upper and lower ends of valve member 98. The operation of the sand collection means 119 will be described in greater detail in connection with the operation of fluid pump 71 in connection with FIGS. 5A and 5B.

It should be noted that to improve the wear characteristics of fluid pump 71, sealing surfaces 88 and 100 and seating surfaces 86 and 101 may be hardened by any suitable process such as carburizing, or alternatively, may be provided with a hardened tungsten carbide surface. With reference now to FIGS. 5A and 5B, the operation of fluid pump 71 will be described in greater detail.

FIG. 5A illustrates fluid pump 71 in its downstroke position, and FIG. 5B illustrates fluid pump 71 in its upstroke position as represented by the respective arrows on valve rod 80. For ease of illustration purposes, fluid pump housing 72 and the production tubing in which fluid pump 71 is disposed in a sealed relationship are not shown. Likewise, the conventional first valve, or lower standing valve, 75 disposed in the lower end 74 of housing 72 are not shown in FIGS. 5A and 5B.

FIG. 5A illustrates the position of the various components of fluid pump 71 when pump 71 is at the bottom of its downstroke at which point in time valve rod 80 has reached the bottom of its downward movement. In this position, the lower standing valve 75 is in a closed seating position and piston, or plunger, 78, has compressed the fluid in the interior of housing 72 disposed between the lower standing valve 75 and the third valve member 98. As seen in FIG. 5A, at the bottom of the downstroke of fluid pump 71, third valve member 98 has been rotated so that the fluid ports 109 and 110 are in an open fluid transmitting relationship whereby the downward movement of plunger, or piston, 78, forces the fluid, trapped in the interior of housing 72 disposed above closed standing valve 75 and contained within the hollow center sections of piston 78 and third valve member 98, to be expelled outwardly and upwardly therefrom through fluid ports 109 and 110. This upwardly travelling fluid then passes through the annular chamber 97 between second valve member 87 and the interior surface 95 of second valve housing 90. The upwardly travelling fluid also passes through and into the interior chamber 117 of second valve member 87 and then through ports 118. The fluid then travels upwardly and through the open hollow section of top valve seat member 89 and through ports 85 of valve rod connector 81 and into the production tubing (not shown). Thus, at the bottom of the downstroke of fluid pump 71, the first valve, or standing valve, 75 is in a closed seated position, second valve member 87 of top valve 76 is in its open position, and the third valve member 98 of the third, or travelling, valve 77 is in its open position.

At the instant that valve rod 80 is mechanically actuated to move upwardly to begin the upstroke portion of fluid pump 71, second valve member 87 of top valve 76 begins its upward, longitudinal movement via the movement of valve rod 80, valve rod connector 81 and rod member 83 pulling upwardly on top valve member 87. This upward, longitudinal movement of top valve member 87 thus causes relative movement between guide surface 112 formed at the bottom of top valve member 87 and the elongate, helically shaped member 111 fixedly secured to the third valve member, or travelling valve, 98, whereby third valve member 98 begins to rotate within its housing 104. Thus, fluid port 110 of third valve member 98 begins to rotate from its open, fluid transmitting relationship with fluid port 109 into its sealed position as shown in FIGS. 4 and 5B. This upward movement likewise causes second valve member 87 to move into its sealed position whereby spherical sealing surface 88 contacts the bevelled seating surface 86, as shown in FIG. 5B. Further, upward movement of valve rod 80 thus pulls plunger 78 upwardly within housing 72, which motion causes a positive vacuum to be formed within the interior of plunger 78 and third valve, or travelling valve, 98. Thus, the first valve, or lower standing valve, 75 is pulled into its open, unsealed position, and fluid is drawn into the interior of the lower end 74 of housing 72 between first valve 75 and third valve 77.

Upon valve rod 80 reaching its uppermost position, lower standing valve 75 will be in its open unsealed position, and the second and third valves 76 and 77 will be in their closed sealed positions as shown in FIG. 5B. Upon valve rod 80 beginning its downstroke movement, top valve 76 will be forced downwardly into an open, unsealed relationship between sealing surface 88 and seating surface 86, and the downward movement of second valve member 87 will thus cause relative movement between guide surface 112 and the helical shaped member 111 of rotation means 79. This relative movement will then begin the rotation of third valve member 98 until it reaches its open, fluid transmitting relationship between fluid ports 109 and 110. Upon valve rod connector 81 abutting the upper surface of top valve seat member 89, the downward movement of piston, or plunger, 78, begins, thus compressing the fluid contained between lower standing valve 75 and third valve member 98. This compressive force in turn forces the lower standing valve 75 into its closed sealed position, whereby the pumping action previously described in connection with FIG. 5A begins again.

It should be noted that although a conventional ball and seat valve, or lower standing valve 75 is shown in FIG. 2, any other type of fluid pressure actuated valve could be utilized, whereas it is necessary that the second and third valves, or top valve and travelling valve, 76 and 77 be mechanically actuated. Thus, "gas locking" is avoided with the fluid pump 71 of the present invention in that the downward movement of valve rod 80 automatically and mechanically causes the opening of the third valve 77 via rotation means 79. Thus the fluid and any gas contained therein are not merely compressed during the downstroke of fluid pump 71, but are rather compressed and expelled upwardly through the automatically and mechanically open third valve 77.

If the fluid to be pumped contains any sand, or other abrasive particles or impurities, such sand should be expelled from fluid pump 71. However, if such impurities should happen to collect within pump 71, they would likely collect in fluid port 109 when the second and third valves 76 and 77 are in their closed position as shown in FIGS. 4 and 5B. Should such sand particles be present, they will likely pass between sealing surface 100 and seating surface 101 and pass downwardly into sand collection means 119 whereat such particles will not affect the operation of fluid pump 71. It should also be noted that the metal to metal wiping action between sealing surface 100 and 101 is not affected by any vibration forces associated with valve rod 80 in that in the closed sealed relationship between fluid ports 109 and 110 as seen in FIG. 4, there is a sufficient distance through which port 110 must be rotated (in the direction shown by the arrow 120) before which time third valve 77 reaches its open, fluid transmitting relationship.

It is to be understood that the invention is not limited to the exact details of construction, operation, exact materials, or embodiment shown and described, as obvious modifications and equivalents will be apparent to one skilled in the art; for example, the cross-sectional configuration of the elongate, helically shaped member and guide surface of the rotation means could be any other suitable configuration so long as the relative motion between the two parts causes rotation of the third valve member. Accordingly, the invention is therefore to be limited only by the scope of the appended claims.

I claim:

1. A fluid pump, comprising:

an elongate housing having upper and lower ends;

first valve disposed in the lower end of the housing;

a second valve disposed in the upper end of the housing and slideably mounted for longitudinal movement with respect to the housing;

a third valve, disposed between the first and second valves, including a rotatable valve member having an upper end with a sealing surface thereon and a seating surface in sliding and wiping engagement with the sealing surface;

a piston for compressing fluid, slideably mounted for longitudinal movement with respect to the housing and disposed within the housing between the first and third valves, the space within the housing between the first and third valves defining a variable volume working chamber; and means for rotating the third valve about its longitudinal axis, said means for rotating being associated with the second and third valves, whereby the longitudinal movement of the second valve causes rotational movement of the third valve.

2. The fluid pump of claim 1 wherein the first valve is actuated by changes in fluid pressure occurring in the housing and the second and third valves are mechanically actuated.

3. The fluid pump of claim 1 wherein the upper end of the valve member tapers upwardly toward the center of the valve member to form the sealing surface and the seating surface is tapered to mate with the sealing surface.

4. The fluid pump of claim 1 wherein the second valve includes: a bevelled seating surface disposed toward the upper end of the housing; and a valve member having a spherical sealing surface at its upper end which contacts the bevelled seating surface.

5. The fluid pump of claim 4 wherein the valve member is an elongate cylindrical member and includes guide means for maintaining the longitudinal movement of the valve member.

6. The fluid pump of claim 5 wherein the valve member includes means for connecting the valve member to a mechanical actuation means.

7. The fluid pump of claim 1 wherein the means for rotating the third valve includes an elongate, helically shaped member and a mating guide surface, whereby relative movement between the helically shaped member and the guide surface causes rotation of the third valve.

8. The fluid pump of claim 7 wherein the third valve has the elongate, helically shaped member fixedly secured thereto and the mating guide surface is associated with the second valve.

9. The fluid pump of claim 1 wherein the seating surface has at least one fluid port formed therein and the mating sealing surface has at least one fluid port formed therein, whereby upon rotation of the valve member the fluid port of the valve member is moved from a mating, fluid transmitting relationship with the seating surface port to a closed, sealed relationship with the seating surface port.

10. The fluid pump of claim 1 wherein the outer cylindrical surface of the valve member is provided with a means for collecting sand and other impurities which may be contained in the fluid to be pumped.

11. The fluid pump of claim 10 wherein the collection means comprises a groove formed in the outer surface of the valve member, and the groove is disposed intermediate the upper and lower ends of the valve member.

12. A mechanically actuated travelling valve and top valve assembly for use in a fluid pump which pump includes an elongate housing, a standing valve in the lower end of the housing, and a piston slideably mounted for longitudinal movement within the housing for compressing fluid disposed in a variable volume working chamber defined by the space within the housing between the travelling valve and the standing valve, comprising:

a first rotatable, elongate, generally cylindrical valve member adapted to be disposed above the piston;

a second elongate cylindrical valve member slideably mounted for longitudinal movement with respect to the housing and disposed above the first valve member; and means for rotating the first valve member about its longitudinal axis, said means for rotating being associated with the first and second valve members, and includes an elongate, helically shaped member and a mating guide surface, whereby relative movement between the helically shaped member and the guide surface caused by longitudinal movement of the second valve member causes rotational movement of the first valve member.

13. The assembly of claim 12 wherein the first valve member has the elongate, helically shaped member fixedly secured thereto and the mating guide surface is associated with the second valve member.

14. The assembly of claim 12 wherein the second valve member includes: a bevelled seating surface disposed toward the upper end of the housing; and the valve member has a spherical sealing surface at its upper end which contacts the bevelled seating surface.

15. The assembly of claim 14 wherein the valve member is an elongate cylindrical member and includes guide means for maintaining the longitudinal movement of the valve member.

16. The assembly of claim 15 wherein the valve member includes means for connecting the valve member to a mechanical actuation means.

17. The assembly of claim 12 wherein the first valve member includes: an upper end with a sealing surface thereon; and a seating surface in sliding and wiping engagement with the sealing surface.

18. The assembly of claim 17 wherein the seating surface has at least one fluid port formed therein and the mating sealing surface has at least one fluid port formed therein, whereby upon rotation of the first valve member the fluid port of the valve member is moved from a mating, fluid transmitting relationship with the seating surface port to a closed, sealed relationship with the seating surface port.

19. The assembly of claim 17 wherein the upper end of the valve member tapers upwardly toward the center of the valve member to form the sealing surface and the seating surface is tapered to mate with the sealing surface.

20. The assembly of claim 17 wherein the outer cylindrical surface of the valve member is provided with a means for collecting sand and other impurities which may be contained in the fluid to be pumped.

21. The assembly of claim 20 wherein the collection means comprises a groove formed in the outer surface of the first valve member, and the groove is disposed intermediate the upper and lower ends of the valve member.

22. A fluid pump, comprising:

an elongate housing having upper and lower ends;

a first valve disposed in the lower end of the housing;

an elongate member, having upper and lower ends, disposed in the upper end of the housing and slideably mounted for longitudinal movement with respect to the housing;

a travelling valve, disposed between the first valve and the elongate member, and including a rotatable elongate, generally cylindrical valve member having an upper end with a sealing surface thereon and a seating surface in sliding and wiping engagement with the sealing surface;

a piston slideably mounted for longitudinal movement within the housing for compressing fluid disposed between the first valve and travelling valve, the space within the housing between the first valve and travelling valve defining a variable volume working chamber; and means for rotating the travelling valve about its longitudinal axis, said means for rotating being associated with the elongate member and travelling valve, whereby longitudinal movement of the elongate member causes rotational movement of the travelling valve.

23. The fluid pump of claim 22 wherein the first valve is actuated by changes in fluid pressure occurring in the housing and the travelling valve and elongate member are mechanically actuated.

24. The fluid pump of claim 22 wherein a bevelled seating surface is disposed toward the upper end of the housing, and the elongate member has a spherical sealing surface at its upper end which contacts the bevelled seating surface associated with the housing.

25. The fluid pump of claim 22 wherein the seating surface has at least one fluid port formed therein and the mating sealing surface has at least one fluid port formed therein, whereby upon rotation of the valve member the fluid port of the valve member is moved from a mating, fluid transmitting relationship with the seating surface port to a closed, sealed relationship with the seating surface port.

26. The fluid pump of claim 22 wherein the upper end of the valve member tapers upwardly toward the center of the valve member to form the sealing surface and the seating surface is tapered to mate with the sealing surface.

27. The fluid pump of claim 22 wherein the elongate member includes guide means for maintaining the longitudinal movement of the elongate member.

28. The fluid pump of claim 27 wherein the elongate member includes means for connecting the elongate member to a mechanical actuation means.

29. The fluid pump of claim 22 wherein the means for rotating the travelling valve includes an elongate, helically shaped member and a mating guide surface, whereby relative movement between the helically shaped member and the guide surface causes rotation of the travelling valve.

30. The fluid pump of claim 29 wherein the travelling valve has the elongate, helically shaped member fixedly secured thereto and the mating guide surface is associated with the elongate member.

31. The fluid pump of claim 22 wherein the outer cylindrical surface of the valve member is provided with a means for collecting sand and other impurities which may be contained in the fluid to be pumped.

32. The fluid pump of claim 31 wherein the collection means comprises a groove formed in the outer surface of the valve member, and the groove is disposed intermediate the upper and lower ends of the valve member.

33. A mechanically actuated travelling valve assembly for use in a fluid pump which pump includes an elongate housing, a standing valve in the lower end of the housing, and a piston, slideably mounted within the housing, for compressing fluid disposed above the standing valve, the space within the housing between the travelling valve assembly and standing valve defining a variable volume working chamber, comprising:

a rotatable travelling valve member adapted to be disposed above the piston;

an elongate member slideably mounted for longitudinal movement with respect to the housing and disposed above the travelling valve member; and means for rotating the travelling valve member about its longitudinal axis, said means for rotating being associated with the travelling valve member and elongate member and includes an elongate, helically shaped member and a mating guide surface, whereby relative movement between the helically shaped member and the guide surface caused by longitudinal movement of the elongate member causes rotational movement of the valve member.

34. The assembly of claim 33 wherein the elongate member includes: a bevelled seating surface disposed toward the upper end of the housing; and the travelling valve member has a spherical sealing surface at its upper end which contacts the bevelled seating surface.

35. The assembly of claim 34 wherein the travelling valve member is an elongate cylindrical member and includes guide means for maintaining the longitudinal movement of the travelling valve member.

36. The assembly of claim 35 wherein the elongate member includes means for connecting the elongate member to a mechanical actuation means.

37. The assembly of claim 33 wherein the travelling valve member has the elongate, helically shaped member fixedly secured thereto and the mating guide surface is associated with the elongate member.

38. The assembly of claim 33 wherein the travelling valve member includes: an upper end with a sealing surface thereon; and a seating surface in sliding and wiping engagement with the sealing surface.

39. The assembly of claim 38 wherein each seating surface has at least one fluid port formed therein and each mating sealing surface has at least one fluid port formed therein, whereby upon rotation of the travelling valve member the fluid port of the travelling valve member is moved from a mating, fluid transmitting relationship with the seating surface ports to a closed, sealed relationship with the seating surface port.

40. The assembly of claim 38 wherein the upper end of the travelling valve member tapers upwardly toward the center of the travelling valve member to form the sealing surface and the seating surface is tapered to mate with the sealing surface.

41. The assembly of claim 38 wherein the outer cylindrical surface of the travelling valve member is provided with a means for collecting sand and other impurities which may be contained in the fluid to be pumped.

42. The assembly of claim 41 wherein the collection means comprises a groove formed in the outer surface of the travelling valve member, and the groove is disposed intermediate the upper and lower ends of the travelling valve member.

43. A fluid pump, comprising:
an elongate housing having upper and lower ends;
a first valve disposed in the lower end of the housing;
a second valve disposed in the upper end of the housing and slideably mounted for longitudinal movement with respect to the housing;
a third valve disposed between the first and second valves;
a piston for compressing fluid, slideably mounted for longitudinal movement with respect to the housing and disposed within the housing between the first and third valves, the space within the housing between the first and third valves defining a variable volume working chamber; and
means for rotating the third valve about its longitudinal axis, said means for rotating being associated with the second and third valves, and includes an elongate, helically shaped member and a mating guide surface, whereby relative movement between the helically shaped member and the guide surface, caused by the longitudinal movement of the second valve, causes rotational movement of the third valve.

44. The fluid pump of claim 43 wherein the third valve has the elongate, helically shaped member fixedly secured thereto and the mating guide surface is associated with the second valve.

45. A mechanically actuated travelling valve and top valve assembly for use in a fluid pump, which pump includes an elongate housing, a standing valve in the lower end of the housing, and a piston slideably mounted for longitudinal movement within the housing for compressing fluid disposed in a variable volume working chamber defined by the space within the housing between the travelling valve and the standing valve, comprising:
a first rotatable valve member adapted to be disposed above the piston and including an upper end with a sealing surface thereon and a seating surface in sliding and wiping engagement with the sealing surface, the seating surface having at least one fluid port formed therein and the mating sealing surface has at least one fluid port formed thereon, whereby upon rotation of the first valve member the fluid port of the valve member is moved from a mating, fluid transmitting relationship with the seating surface port to a closed, sealed relationship with the seating surface port;
a second elongate cylindrical valve member slideably mounted for longitudinal movement with respect to the housing and disposed above the first valve member; and
means for rotating the first valve member about its longitudinal axis, said means for rotating being associated with the first and second valve members, whereby longitudinal movement of the second valve member causes rotational movement of the first valve member.

46. The assembly of claim 45 wherein the upper end of the valve member tapers upwardly toward the center of the valve member to form the sealing surface and the seating surface is tapered to mate with the sealing surface.

47. A fluid pump, comprising:
an elongate housing having upper and lower ends;
a first valve disposed in the lower end of the housing;
an elongate member, having upper and lower ends, disposed in the upper end of the housing and slideably mounted for longitudinal movement with respect to the housing;
a travelling valve, disposed between the first valve and the elongate member;
a piston slideably mounted for longitudinal movement within the housing for compressing fluid disposed between the first valve and travelling valve, the space within the housing between the first valve and travelling valve defining a variable volume working chamber; and
means for rotating the travelling valve about its longitudinal axis, said means for rotating being associated with the elongate member and travelling valve and includes an elongate helically shaped member and a mating guide surface, whereby relative movement between the helically shaped member and the guide surface caused by the longitudinal movement of the elongate member causes rotational movement of the travelling valve.

48. The fluid pump of claim 47 wherein the travelling valve has the elongate, helically shaped member fixedly secured thereto and the mating guide surface is associated with the elongate member.

49. A mechanically actuated travelling valve assembly for use in a fluid pump which pump includes an elongate housing, a standing valve in the lower end of the housing, and a piston, slideably mounted within the housing, for compressing fluid disposed above the standing valve, the space within the housing between the travelling valve assembly and standing valve defining a variable volume working chamber, comprising:
a rotatable travelling valve member, adapted to be disposed above the piston, and including an upper end with a sealing surface thereon and a seating surface in sliding and wiping engagement with the sealing surface;
an elongated member slideably mounted for longitudinal movement with respect to the housing and disposed above the travelling valve member; and
means for rotating the travelling valve member about its longitudinal axis, said means for rotating being associated with the travelling valve member and elongate member and whereby longitudinal movement of the elongate member causes rotational movement of the valve member.

50. The assembly of claim 49 wherein each seating surface has at least one fluid port formed therein and each mating sealing surface has at least one fluid port formed therein, whereby upon rotation of the travelling valve member the fluid port of the travelling valve member is moved from a mating, fluid transmitting relationship with the seating surface port to a closed, sealed relationship with the seating surface port.

51. The assembly of claim 49 wherein the upper end of the travelling valve member tapers upwardly toward the center of the travelling valve member to form the sealing surface and the seating surface is tapered to mate with the sealing surface.

* * * * *